US005118254A

United States Patent [19]

Ellingson et al.

[11] Patent Number: 5,118,254

[45] Date of Patent: Jun. 2, 1992

[54] APPARATUS AND METHOD FOR DISHWASHER PUMP MOUNTING

[75] Inventors: David I. Ellingson; Donald E. Erickson; Lawrence J. Jordan, all of Newton, Iowa; Lawrence L. Quayle, Harpers Ferry, W. Va.

[73] Assignee: Maytag Corporation, Newton, Iowa

[21] Appl. No.: 708,213

[22] Filed: May 31, 1991

[51] Int. Cl.[5] ..... F04D 29/60

[52] U.S. Cl. ..... 415/213.1; 417/360; 417/363; 403/348; 285/362

[58] Field of Search ..... 415/213.1; 417/360, 417/363; 403/348, 349; 285/362, 159; 29/890.141

[56] References Cited

U.S. PATENT DOCUMENTS

| | | | |
|---|---|---|---|
| 2,283,974 | 5/1942 | Dillon | 285/175 |
| 2,496,928 | 2/1950 | Bing et al. | 403/348 |
| 2,561,279 | 7/1951 | Holt | 403/349 |
| 3,406,637 | 10/1968 | Perl | 415/213.1 |
| 3,446,155 | 5/1969 | Guth | 103/218 |
| 3,583,835 | 6/1971 | Coburn, Sr. et al. | 417/360 |
| 3,825,373 | 7/1974 | Jenkins | 417/360 |
| 4,060,346 | 11/1977 | Meyers | 417/360 |
| 4,125,339 | 11/1978 | Pittinger, Sr. et al. | 403/348 |
| 4,221,547 | 9/1980 | Hoffman et al. | 417/363 |

*Primary Examiner*—Edward K. Look
*Assistant Examiner*—Michael S. Lee
*Attorney, Agent, or Firm*—Richard L. Ward

[57] ABSTRACT

A pump mount is provided for a dishwasher having a tub with an opening in the sump defined by a radially inwardly directed annular flange. A pump housing includes a plurality of ramp members spaced around its periphery and a seal is located between the pump housing and the flange for retaining washing fluid in the tub when the pump housing is assembled to the tub. A locking member is engageable with the pump housing ramp members for assembling the pump housing to the tub. In the preferred embodiment a locking member is rotatable relative to the pump for effecting axial movement of the pump housing relative to the tube to compress the seal and form a fluid tight joint.

19 Claims, 6 Drawing Sheets

APPARATUS AND METHOD FOR DISHWASHER PUMP MOUNTING

BACKGROUND OF THE INVENTION

1. Field of the Invention

The present invention is generally directed to mounting a dishwasher pump in a dishwasher tub, and more particularly, to a mounting system that eliminates the use of complicated or multiple fasteners while requiring only one hand to install or remove the pump.

2. Description of the Prior Art

A variety of means for mounting a pump in a dishwasher are available. A pump is normally mounted in a dishwasher through an opening provided in the sump of the dishwasher tub. A leak-proof seal must be maintained between the pump and the opening so that fluid present in the tub does not leak out of the opening. The leakage of fluid can damage the pump's motor which is generally attached to the pump and located between the dishwasher tub and the floor surface under the dishwasher.

Various means have been used to mount a pump in a dishwasher and to create a leak-proof seal. U.S. Pat. No. 3,825,373 (Jenkins) discloses a clamping band engaging a ring of the sump. Tightening the band draws the motor-pump assembly downward to create a seal by exerting a radially inward pressure relative to a vertical axis through the bottom wall opening that is translated to a vertically downward pressure.

Other devices use clips to exert pressure on the pump and thus create a seal. U.S. Pat. No. 4,060,346 (Meyers) discloses an apparatus using wire springs that are hooked onto posts on the top of the motor portion of the motor-pump. Toggles located on the springs are rotated to cam and tension the springs to apply a predetermined, substantially constant force between the tank and the motor-pump assembly. U.S. Pat. No. 3,583,835 (Coburn et al.) discloses spring clips having two spring portions. One spring portion bears upwardly against the bottom of the pump body while the other bears downwardly against the motor.

Other devices use various sorts of connectors. U.S. Pat. No. 4,221,547 (Hoffman et al.) discloses a sleeve clamped to a pump whereby the sleeve is attached to the sump by threaded inserts. U.S. Pat. No. 3,446,155 (Guth) discloses a boot, a support ring and a clamping ring which attaches the pump-motor assembly to the sump shoulder.

Connectors not associated with dishwasher pumps are disclosed in U.S. Pat. No. 4,125,339 (Pittinger, Sr. et al.) where a twist lock connector comprising a male connector located on a housing and a complimentary female connector located on a shield attachment are locked together by a half-turn rotation. U.S. Pat. No. 2,283,974 (Dillon) discloses a pipe coupling that can be easily fastened or loosened. A threaded member is advanced to tighten the joint and reversed to loosen the joint.

Accordingly, it is a primary object of the present invention to provide a dishwasher pump mounting system that provides a leak-proof seal between the pump and the opening in the sump of the dishwasher tub without the use of complicated or multiple fasteners.

Another object is to provide a dishwasher pump mounting system wherein a pump can be installed or removed for servicing with one hand thereby reducing the cost and labor associated with installing or removing a pump for repair.

Further objects and advantages will become apparent from the following description and the accompanying drawings.

SUMMARY OF THE INVENTION

Briefly, the instant invention achieves these objects in a pump mounting system for a dishwasher having a tub with an opening in the sump defined by a radially inwardly directed annular flange. A pump housing has a plurality of ramp members spaced around the periphery thereof and a seal is located between the pump housing and the flange opening for retaining washing fluid in the tub when the pump housing is assembled thereto. A coupling structure is provided which is engageable with the pump housing ramp members for assembling the pump housing to the tub. One of the pump housing and the coupling structure is rotatable relative to the other of the pump housing and coupling structure for effecting axial movement of the pump housing relative to the tub to compress the seal and form a fluid tight joint.

The present invention provides a simple pump mounting system that can be operated to either install the pump in the dishwasher or remove the pump from the dishwasher. In addition, a leak-proof seal is created between the pump and the sump opening thereby preventing fluid from leaking from the dishwasher tub.

BRIEF DESCRIPTION OF THE DRAWINGS

Further objects and advantages of this invention will become more apparent and readily appreciated from the following detailed description of the present invention, taken in conjunction with the accompanying drawings, of which.

DETAILED DESCRIPTION OF THE PRESENTLY PREFERRED EMBODIMENTS

Figure 1:
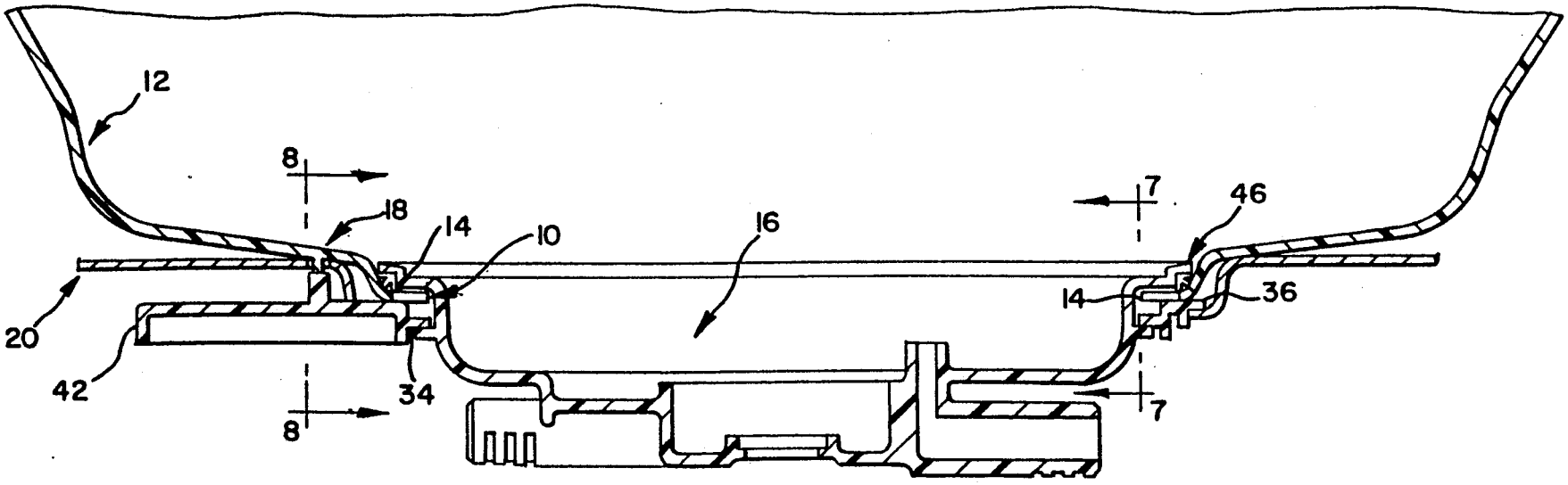
FIG. 1 is a cross-section of the present invention in a locked position.

FIG. 1 is a cross-section of the present invention in a locked position. A flanged opening 10 is located in the sump area of a dishwasher tub 12. While the preferred embodiment describes a molded plastic dishwasher tub, it is contemplated that the pump mounting means of the instant invention is also applicable to a metal dishwasher tub. Around the periphery of the opening 10 of the dishwasher tub 12 are tabs 14 extending in a radial inward direction towards the center of the opening 10. The tabs 14 can be equally or unequally spaced. The diameter of the opening 10 allows a pump 16 to be dropped through the opening 10. The tabs 14 extending from the opening 10, however, at least partially support the pump 16 and prevent it from being dropped all the way through the opening 10. The tabs 14 also prevent the pump 16 from rotating when it is locked into position which will be further described. Molded into the exterior of the dishwasher tub 12 are downwardly projecting teeth 18. The function of these teeth 18 will be described with respect to the assembly of the present invention. The dishwasher tub 12 may be supported by a tub support 20 which is formed from sheet metal. Although a tub support 20 is illustrated, the present invention can also be used independent of a tub support as will be later described.

Figure 2:
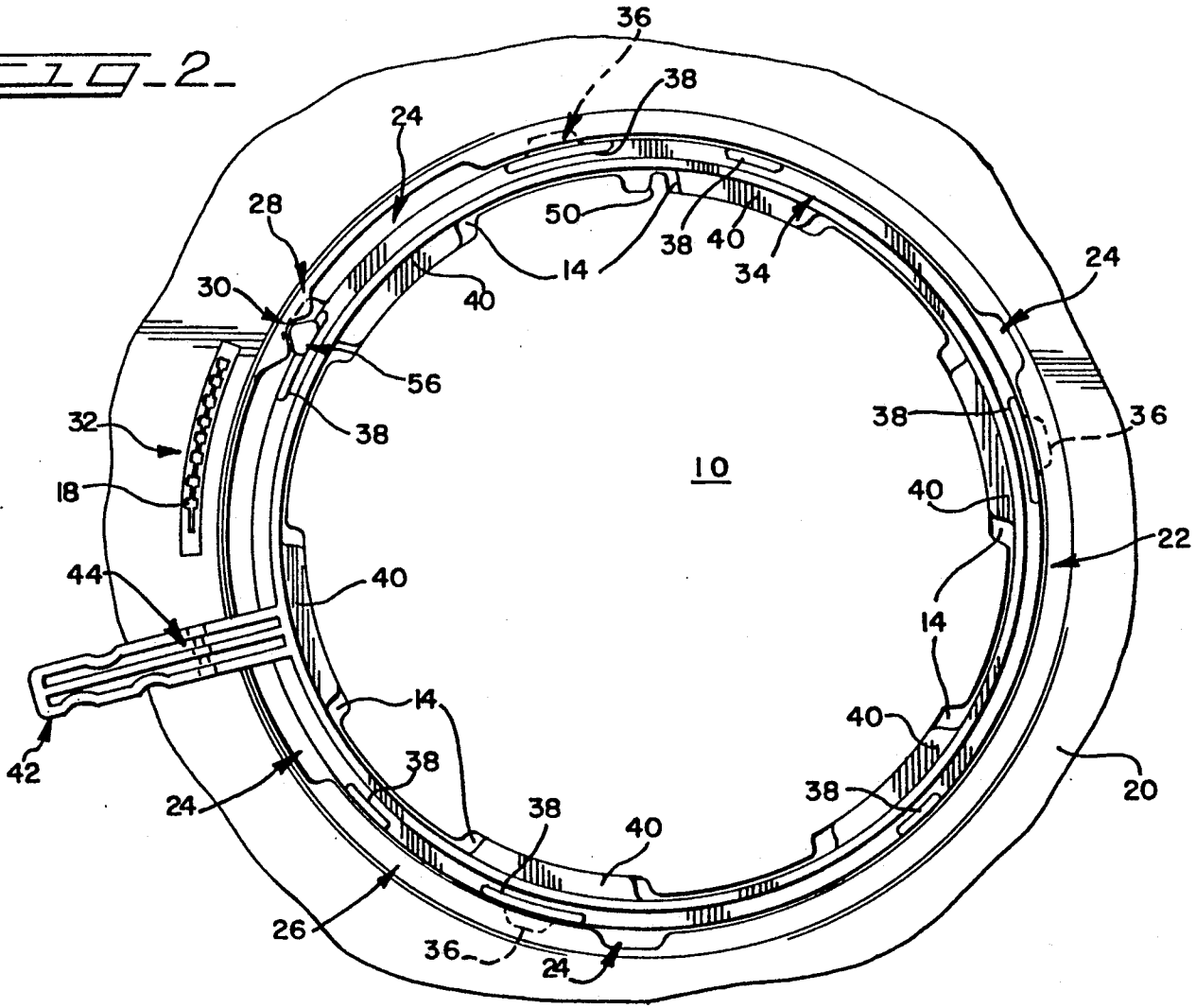
FIG. 2 is a plan view from below the tub support of a locking ring assembled in the receiving position.
Figure 12:
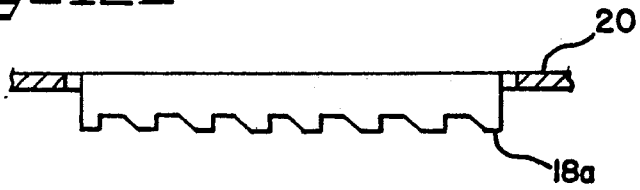
FIG. 12 is a view showing locking teeth formed in the tub support.

FIG. 2 is a plan view from below the tub support 20 of a locking ring 34 positioned in the receiving position. The tub support 20 has an opening 22 of at least the same diameter as the opening 10 of the dishwasher tub 12. The two openings 10 and 22 are substantially concentric when the dishwasher tub 12 is mounted on the tub support 20. The tub support opening 22 has cutouts 24 which interrupt a flange 26. The cutouts 24 are spaced irregularly around the circumference of the flange 26 in opening 22. In addition, a cam 28 and lock notch 30 are provided. A cutout 32 is provided alongside the opening 22 in the tub support 20 through which the teeth 18 molded on the exterior of the dishwasher tub 12 are accessible through the tub support 20. Alternatively, as shown in FIG. 12, teeth 18*a* may be punched or formed into the sheet metal support 20 instead of being molded on the exterior of the dishwasher tub 12 in which case the cutout 32 is not needed.

A locking ring 34 according to the present invention has a plurality of radially outwardly extending tabs 36 spaced around its outer periphery. The locking ring 34 further includes a plurality of downwardly projecting arcuate wall segments 38. The outside radius of the wall segments 38 correspond substantially to the radius of opening 22 in the support 20 for guiding the locking ring 34 as it is operated relative to opening 22. There is a wall segment 38 located next to each tab 36. The spacings of the cutouts 24 in the flange 26 of the tub support 20 correspond with the spacing of the tabs 36 on the locking ring 34 so that each tab 36 is aligned with a cutout 24 when the locking ring 34 is properly positioned to be assembled to the tub support 20. The irregular spacing of the cutouts 24 in the flange 26 requires that the locking ring 34 be orientated a particular way as it is placed in the tub support 20. A plurality of ramps 40 are located around the inner periphery of the locking ring 34. The ramps 40 can be equally or unequally spaced around the ring 34. In the present embodiment they are equally spaced. A handle 42 extends radially from the outer periphery of the locking ring 34. Locking teeth 44 are molded on one surface of the handle 42.

Figure 3:
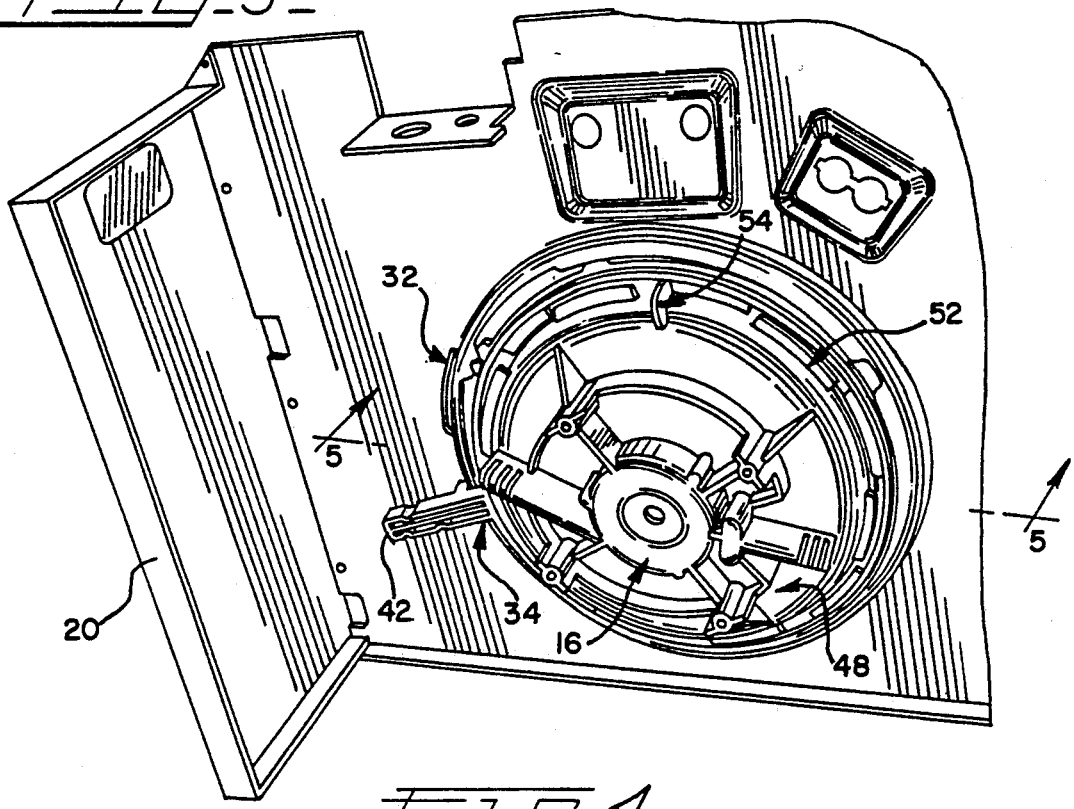
FIG. 3 is a perspective view of a pump mounted with the locking ring in the receiving position.
Figure 5:
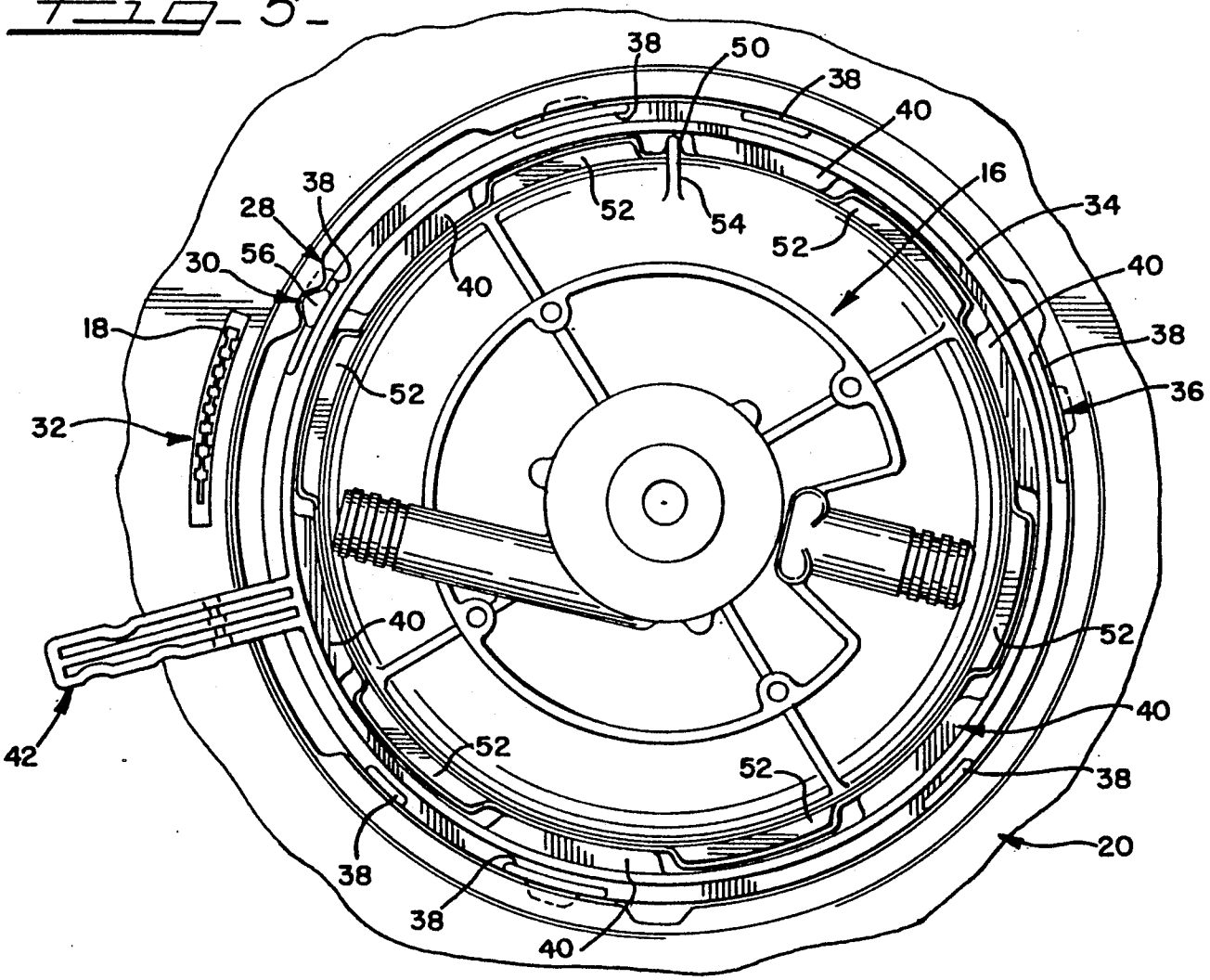
FIG. 5 is a plan view of the pump shown in FIG. 3.
Figure 6:
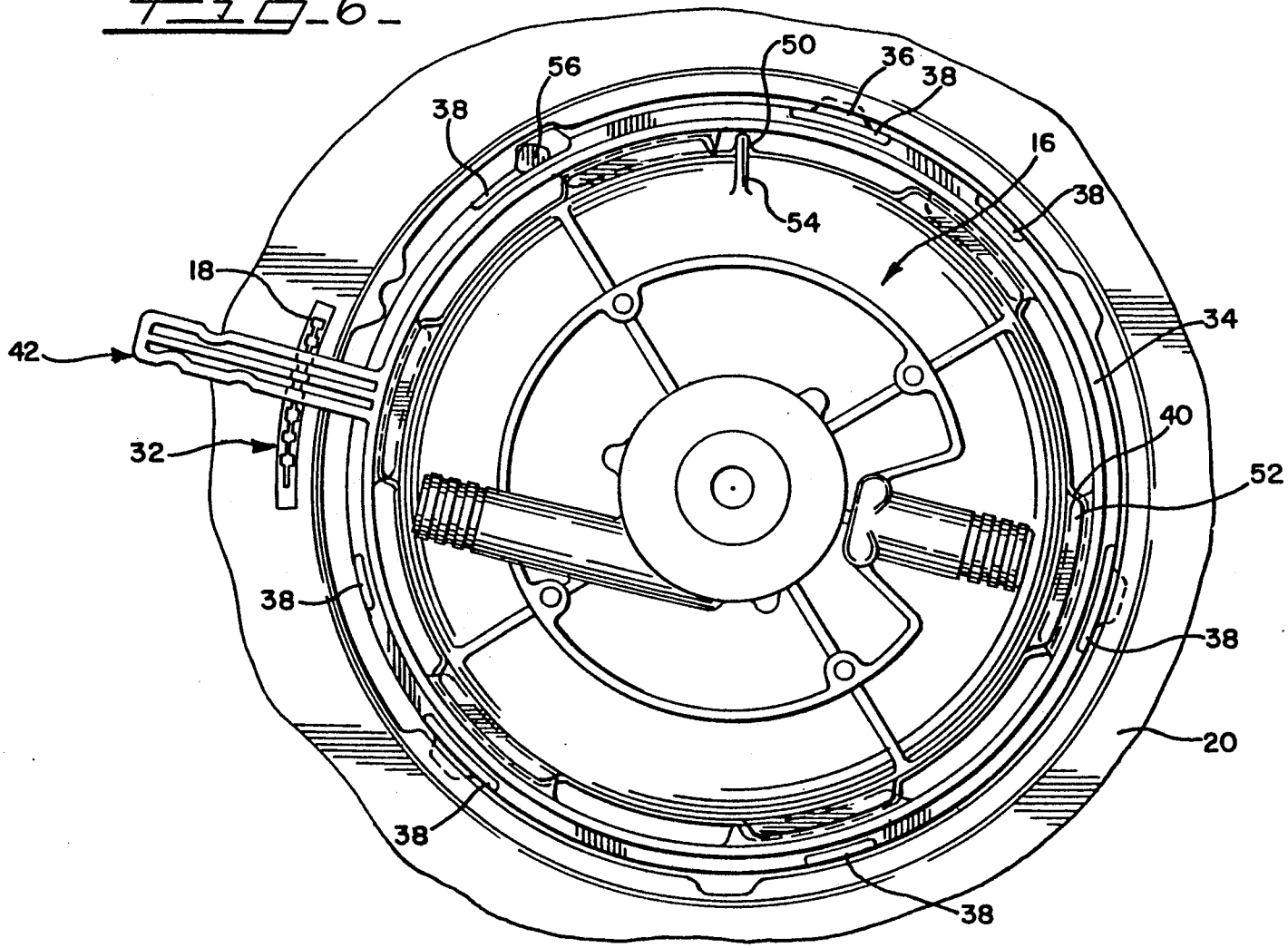
FIG. 6 is a plan view of the pump shown in FIG. 4.

FIG. 3 is a perspective view of a pump 16 mounted with the locking ring 34 in the receiving position. The pump 16 comprises a housing formed by a top cover (not shown) and a bottom housing 48. The bottom housing 48 is bowl shaped and has a rim (shown in FIG. 1 as 46) located at the top of the bottom housing 48. The bottom housing 48 has a plurality of ramps 52 molded into the exterior surface below the rim 46. The ramps 52 are shown as being equally spaced on a diameter corresponding to the diameter of ramps 40 on locking ring 34. They may also be unequally spaced apart if the ramps 40 on the inner periphery of the locking ring 34 are also unequally spaced apart. In addition, a locator lug 54 is molded on the exterior of the bottom housing 48. A corresponding notch indicated at 50 in FIG. 2 and in FIGS. 5 and 6, is located in the dishwasher tub 12. The locator lug 54 allows the pump 16 to be dropped into the tub opening 10 in only one correct position as will be described in the assembly portion of the description. Locator lug 54 cooperates with notch 50 to prevent rotation of pump 16. A gasket or seal 17 shown in FIG. 1 is placed below the rim 46 of the pump bottom housing 48.

The assembly of the present invention will now be described with reference to FIGS. 1–2 and 5–8. The locking ring 34 must first be assembled to the tub support 20 so that the locking ring 34 rests in a receiving position. To mount the locking ring 34, the locking ring 34 is brought from underneath the tub support 20 with the teeth 44 on the handle 42 facing the tub support 20, as shown in FIG. 2. The tabs 36 on the locking ring 34 are aligned with the support cutouts 24. When the locking ring 34 is raised towards the tub support 20, the tabs 36 fit inside the support cutouts 24. After the tabs 36 have passed through the support cutouts 24, the locking ring 34 is rotated slightly, approximately 7.5 degrees clockwise as viewed in FIGS. 2, 5 and 6, so that the tabs 36 are no longer aligned with the cutouts 24 but rather rest on the flange 26 of the support opening 22. The locking ring 34 is thus supported on flange 26 by the tabs 36 which prevents the locking ring 34 from falling through the support opening 22. At the same time, the ring lug 56 has moved an equal amount causing the ring lug 56 to slide over the support cam 28 and fall into the support lock notch 30 located in the tab support 20.

The locking ring 34 is now in a position to receive the pump 16. Since the tabs 36 support the ring 34 in its receiving position the pump 16 can be dropped into the tub opening 10 without requiring the locking ring 34 to be held in place. The tabs 14 around the tub opening 10 generally engage the rim 46 of the pump's bottom housing 48. The locator lug 54 on the exterior of the pump bottom housing 48 requires that the pump 16 be aligned with a corresponding notch 50 in the dishwasher tub 12 before the pump 16 can drop through the opening 10 in the tub 12. As best shown in FIG. 5, the ramps 52 located on the exterior surface of the pump bottom housing 48 fit between the tabs 14 on the dishwasher tub 12 and the ramps 40 located on the inner periphery of the locking ring 34.

FIGS. 3 and 5 illustrate the pump 16 mounted with the locking ring 34 in the receiving position. It can be seen from these illustrations that the assembly is self supporting thus eliminating the need for a means to support the assembly while it is in the receiving position.

Figure 4:
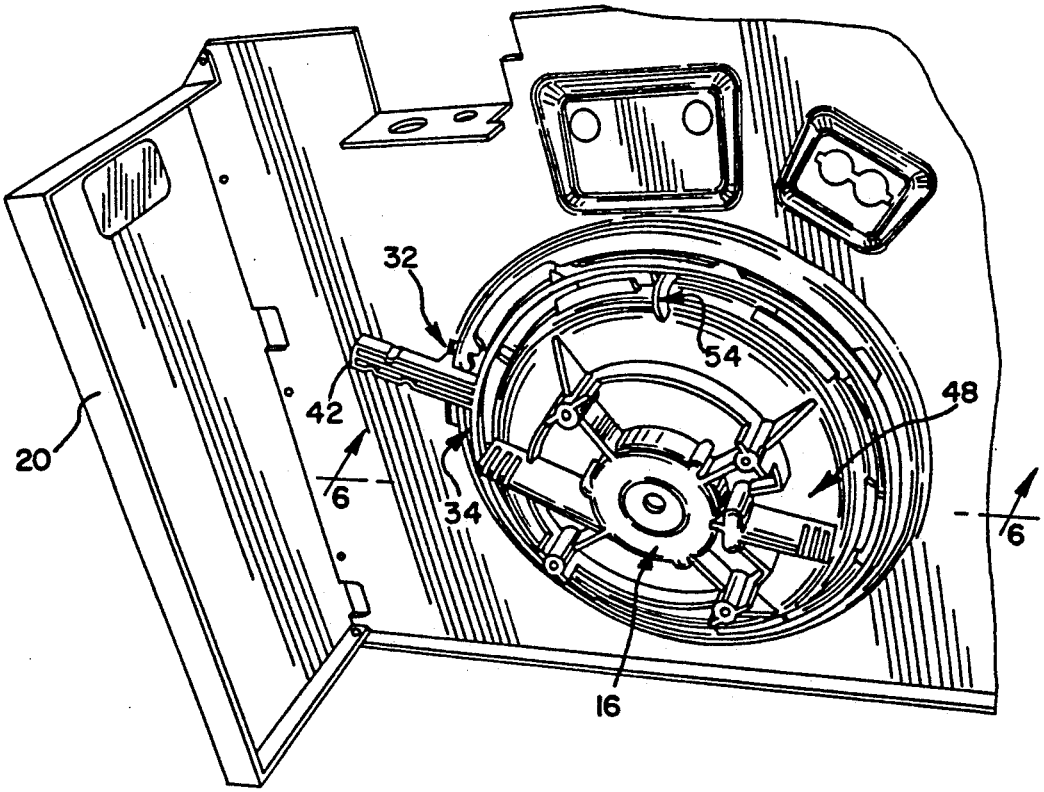
FIG. 4 is a perspective view of a pump mounted with the locking ring in the locked position.

FIGS. 4 and 6 illustrate the pump 16 mounted with the locking ring 34 in the locked position. To lock the pump 16 in position and axially compress seal 17, the locking ring 34 is rotated by means of the handle 42. Because the locking ring 34 is supported in its receiving position by the tabs 36, only one hand is needed to lock the pump 16 in a sealing position. The ramps 40 located on the inner periphery of the locking ring 34 engage with and slide over the ramps 52 located on the exterior surface of the pump bottom housing 48 as the locking ring 34 is rotated toward its locked position. When the ramps 40 and 52 are engaged with each other and the locking ring 34 is rotated, the pump 16 is pulled in an axially downward direction towards the locking ring 34. It is noted that the locking ring 34 does not have to be supported by tub support 20 but could, instead, be a loose member operable for drawing the pump 16 axially downward in tub opening 10.

Figure 7:
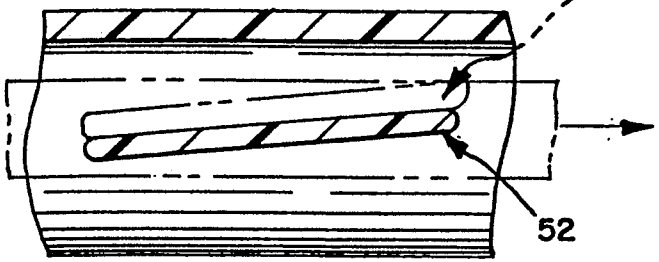
FIG. 7 is an enlarged view of a locking ring ramp engaged with a pump housing ramp shown out of order with FIG. 1.

FIG. 7 illustrates a locking ring ramp 40 engaged with a pump ramp 52. Since the locking ring ramp 40 slides on top of the pump ramp 52, the pump 16 is downwardly biased. The downward movement of the pump 16 causes the gasket 17 located under the rim 46 of the pump bottom housing 48 to compress between the rim 46 and the flanged opening 10 as shown in FIG. 1, thereby creating a tight seal which reduces the possibility of fluid leaking from the dishwasher tub 12. The pump 16 is prevented from rotating by the locator lug 54 on the pump 16 engaging with notch 50.

Figure 8:
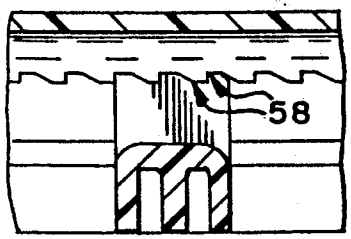
FIG. 8 is an enlarged view of the restraining means in accordance with the present invention shown out of order with FIG. 1.

Vibrational forces caused by dishwasher operation or accidental rotation of the locking ring 34 may cause the locking ring 34 to rotate from its locked position toward its receiving position. Once the locking ring 34 is rotated t the locked position of FIGS. 4 and 6, means must be provided to prevent the locking ring 34 from rotating from its locked position toward its receiving position. To prevent this, the locking teeth 44 on the handle 42 deflect over the series of teeth 18 molded on the exterior of the dishwasher tub 12. The engaged teeth 18 and 44 provide a locking action that prevents the rotation of the locking ring 34 unless the handle 44 is deliberately deflected to disengage the teeth 44 from teeth 18. Alternatively, as shown in FIG. 12, teeth 18*a* may be punched or formed into the tub support 20 instead of molded to the exterior of the dishwasher tub 12. In addition, as shown in FIG. 8, the teeth 44 of the locking ring 34 and the dishwasher tub 12 may have ribs 58 to create wider teeth. These wider teeth provide more engaged surface to prevent stripping and provide sufficient overlap to keep the teeth engaged even with the misalignment between the tub dishwasher 12, tub support 20 or locking ring 34.

Figure 9:
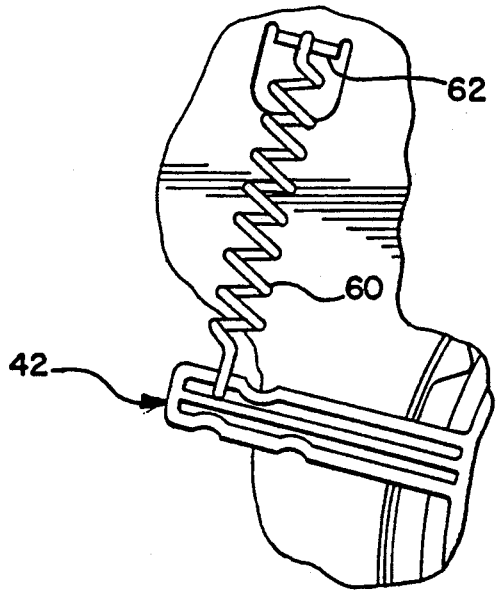
FIG. 9 is a view showing an alternate restraining means.

Shown in FIG. 9 is an alternative to providing teeth in the dishwasher tub 12 or tub support 20 and in the locking ring handle 42. In this alternate construction, the locking ring 34 is continually biased in the locking direction by a spring 60 which is attached between the handle 42 and a tab 62 formed out of the tub support 20. In this alternate construction, tension provided by spring 60 will bias the locking ring 34 for rotation in the locking direction to compensate for any creep in the mating plastic parts. It is envisioned that a sheet steel spring clip could also be utilized for this purpose.

To unlock the pump 16, the locking ring handle 42 is deflected away from the tub support 20 so that the ring teeth 44 disengage from the tub teeth 18. The locking ring 34 is then rotated in an opposite direction forcing the ring lug 56 to slide over the support cam 28 and into the support lock notch 30. The ramps 40 of the ring 34 slide off of the pump ramps 52 thereby relieving pressure on the pump 16. The pump 16 can then be lifted out of the dishwasher tub 12 for servicing or repair. The locking ring 34 is retained in the tub support 20 in its receiving position by the tabs 36 which rest on the flange 26 and the ring lug 56 located in the support lock notch 30. If the locking ring 34 is to be removed from the tub support 20, it must be rotated so that the ring lug 56 slides out of the support lock notch 30 and the tabs 36 become aligned with the support cutouts 24.

Figure 10:
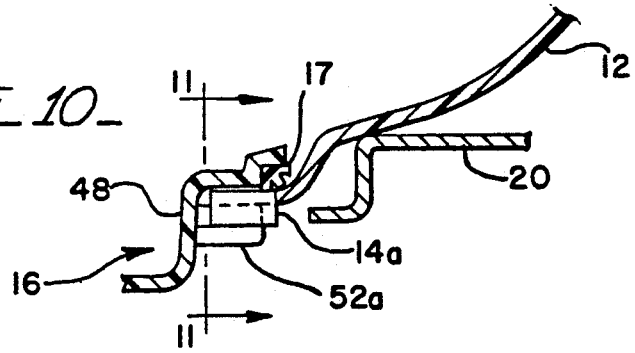
FIG. 10 is a partial fragmentary section view similar to FIG. 1 showing an alternate locking ramp system.
Figure 11:
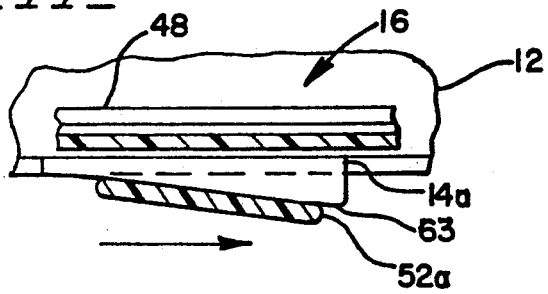
FIG. 11 is a partial fragmentary section view taken generally along lines 11—11 of FIG. 10.

In an alternate embodiment as best shown in FIGS. 10 and 11, the tabs 14*a* formed around the periphery of opening 10 in the dishwasher tub 12 include integrally molded ramps 63 which are engageable with ramps 52*a* on the pump bottom housing 48, for coupling the pump 16 to the dishwasher tub 12. As will be understood from the description above, instead of rotating a locking ring 34 to its locked position, the pump 16 is rotated in this embodiment since the integrally molded ramps 63 are formed in the tub opening 10. In this embodiment, a single fastener (not shown) can secure the pump 16 to the tub 12 once locked in place.

The operation of the alternate embodiment of the present invention will now be described. The pump 16 is inserted into the tub opening 10 with the ramps 52*a* aligned to fit between the tabs and ramps 14*a* and 63 of the tub opening 10. After the pump 16 is placed in the tub opening 10, it can be rotated in the direction of the arrow in FIG. 11 to its locked position. As the pump 16 is rotated, the ramps 52*a* of the pump 16 engage with and slide under the ramps 63 of the opening 10. In this method of mounting downward pressure must be applied to compress the gasket 17 while rotating the pump 16.

To remove the pump 16 from the dishwasher, the pump 16 is rotated in an opposite sense so that the ramps 52*a* of the pump 16 are disengaged from the ramps 63 of the opening 10.

While this invention has been shown and described in connection with the preferred embodiments, it is apparent that certain changes and modifications, in addition to those mentioned above, may be made from the basic features of the present invention. Accordingly, it is the intention of the Applicant to protect all variations and modifications within the true spirit and valid scope of the present invention.

What is claimed is:

1. Pump mounting means for a dishwasher having a tub with an opening in the sump defined by a radially inwardly directed annular flange comprising:

a pump housing having a plurality of ramp members spaced around the periphery thereof;

seal means between said pump housing and said flange for retaining washing fluid in said tub when said pump housing is assembled to said tub; and coupling means engageable with said pump housing ramp members for assembling said pump housing to said tub, one of said pump housing and said coupling means rotatable relative to the other for effecting axial movement of said pump housing relative to said tub to compress said seal means and form a fluid tight joint.

2. Pump mounting means according to claim 1 wherein said coupling means includes a locking ring adjacent said flange opening having ramp engaging means and being rotatable relative to said pump housing for effecting axial movement of said pump housing relative to said tub to secure said pump housing in said flange opening and compress said seal means.

3. Pump mounting means according to claim 1 wherein said coupling means includes ramp engaging means integral with said tub and cooperable with said pump housing ramp members upon manipulation of said pump housing to secure said pump housing in said flange opening and compress said seal means.

4. Pump mounting means for a dishwasher having a tub with an opening in the sump defined by a radially inwardly directed annular flange comprising:

tub support means;

a pump housing having a plurality of ramp members spaced around the periphery thereof;

seal means between said pump housing and said flange opening for retaining washing fluid in said tub when said pump housing is assembled to said tub; and locking means positioned outside of said tub adjacent said flange opening for assembling said pump housing to said tub, said locking means including ramp engaging means cooperative with said pump housing ramp members upon rotation of said locking means for effecting axial movement of said pump housing relative to said tub to compress said seal means and form a fluid tight joint.

5. Pump mounting means according to claim 4 wherein said locking means further comprises means for restraining said locking means when said pump housing ramp members are engaged with said ramp engaging means.

6. Pump mounting means according to claim 5 wherein said restraining means comprises first teeth molded on said locking means engaging second teeth molded on the exterior of said tub.

7. Pump mounting means according to claim 5 wherein said restraining means comprises teeth molded on said locking means engaging mating teeth formed into said tub support means.

8. Pump mounting means according to claim 5 wherein said restraining means comprises means for biasing said locking means in a ramp engaging direction.

9. Pump mounting means according to claim 4 wherein said locking means comprises a ring having an inner and an outer periphery wherein said ramp engaging means are located on the inner periphery of said ring.

10. Pump mounting means according to claim 9 wherein a ring lug is provided on said outer periphery of said ring, said ring lug cooperating with a notch located in said tub support means to locate said ring in a position to receive said pump housing.

11. Pump mounting means according to claim 9 wherein said ring further comprises a handle extending from the outer periphery of said ring whereby said handle is used to rotate said ring.

12. Pump mounting means for a dishwasher having a tub with an opening in the sump defined by a radially inwardly directed annular flange comprising:

a pump housing having a plurality of ramp members spaced around the periphery thereof;

seal means between said pump housing and said flange opening for retaining washing fluid in said tub when said pump housing is assembled to said tub; and locking means associated with said flange opening including a plurality of ramp engaging means integral with said tub and cooperative with said pump housing ramp members upon manipulation of said pump housing for effecting movement of said pump housing to secure said pump housing in said flange opening and compress said seal means forming a fluid tight joint.

13. A dishwasher having an improved pump mounting system, comprising:

a tub having a bottom wall with a sump opening defined by a radially inwardly directed annular flange;

a plurality of radially inwardly extending tabs spaced around the periphery of said annular flange defining a plurality of cut-outs therebetween;

a pump housing having a plurality of ramp members spaced around the periphery thereof and cooperable with said cut-outs for positioning said pump housing in a predetermined angular posture on said annular flange;

seal means between said pump housing and said annular flange for retaining washing fluid in said tub when said pump housing is assembled thereto; and locking means positioned outside of said tub adjacent said sump opening for assembling said pump housing to said tub, said locking means including ramp engaging means cooperable with said pump housing ramp members upon rotation of said locking means for effecting axial movement of said pump housing relative to said tub to compress said seal means and form a fluid tight joint.

14. A pump mounting method for use in a dishwasher having a tub with an opening in the sump defined by a radially inwardly directed annular flange comprising the steps of:

affixing a washing fluid retaining seal to a pump housing;

inserting said pump housing through said flange opening, said pump housing having a plurality of ramp members spaced around the periphery thereof and in cooperative juxtaposition to ramp engaging means associated with said flange; and rotating said pump housing to a predetermined angular position in said tub for effecting axial movement of said pump housing to assemble said pump housing to said tub and compress said seal to form a fluid tight joint.

15. A pump mounting method for use in a dishwasher having a tub with an opening in the sump defined by a radially inwardly directed annular flange comprising the steps of:

attaching said tub to a tub support;

affixing a washing fluid retaining seal to a pump housing;

inserting said pump housing into said tub through said flange opening in a predetermined angular position, said pump housing having a plurality of ramp members spaced around the periphery thereof;

positioning locking means outside of said tub adjacent said flange opening for locking said pump housing to said tub; and rotating said locking means to move ramp engaging means thereon into cooperative engagement with said pump ramp members for effecting axial movement of said pump housing to compress said seal and form a fluid tight joint.

16. A pump mounting method according to claim 15 and further including restraining said locking means when said pump ramp members are engaged with said ramp engaging means.

17. A pump mounting method according to claim 16 wherein said restraining includes engaging first teeth molded on said locking means with second teeth molded on the exterior of said tub.

18. A pump mounting method according to claim 16 wherein said restraining includes engaging teeth molded on said locking means with mating teeth formed into said tub support.

19. A pump mounting method according to claim 16 wherein said restraining includes biasing said locking means in a ramp engaging direction.

* * * * *